US010752407B1

(12) United States Patent
Nelson et al.

(10) Patent No.: US 10,752,407 B1
(45) Date of Patent: Aug. 25, 2020

(54) TAMPER-EVIDENT PRODUCE CONTAINER

(71) Applicant: Mission Produce, Inc., Oxnard, CA (US)

(72) Inventors: Charles Nelson, Oxnard, CA (US); Leonardo Lira, Camarillo, CA (US)

(73) Assignee: Mission Produce, Inc., Oxnard, CA (US)

( * ) Notice: Subject to any disclaimer, the term of this patent is extended or adjusted under 35 U.S.C. 154(b) by 0 days.

(21) Appl. No.: 16/861,574

(22) Filed: Apr. 29, 2020

(51) Int. Cl.
*B65D 43/02* (2006.01)
*B65D 1/22* (2006.01)
*B65D 85/34* (2006.01)

(52) U.S. Cl.
CPC ..... *B65D 43/0204* (2013.01); *B65D 1/22* (2013.01); *B65D 85/34* (2013.01); *B65D 2401/10* (2020.05); *B65D 2543/00148* (2013.01); *B65D 2543/00296* (2013.01); *B65D 2543/00574* (2013.01)

(58) Field of Classification Search
CPC ..... B65D 43/0204; B65D 1/22; B65D 85/34; B65D 2401/10; B65D 2543/00574; B65D 2543/00296; B65D 2543/00148; B65D 43/0233; B65D 2543/00842; B65D 43/22; B65D 5/12; B65D 5/247; B65D 5/6608; B65D 5/685
USPC ..... 220/260
See application file for complete search history.

(56) References Cited

U.S. PATENT DOCUMENTS 3,767,110 A * 10/1973 Congleton ..... B65D 43/162 220/4.23
4,187,977 A 2/1980 Boykin et al.
4,567,996 A * 2/1986 Muise ..... B65D 5/005 206/509
4,585,138 A * 4/1986 Jonkers ..... B65F 1/1615 220/615
4,782,977 A * 11/1988 Watanabe ..... B65D 55/024 220/324
4,986,438 A * 1/1991 Borst ..... B65D 43/0218 220/315
5,121,877 A * 6/1992 Bodary ..... B65D 5/4295 229/120
5,311,990 A * 5/1994 Kalinski ..... B65D 25/04 206/370

(Continued)

FOREIGN PATENT DOCUMENTS

EP 1876103 A1 1/2008

OTHER PUBLICATIONS

Bonar, Updated: Stone Fruit From Trader Joe ' s , Costco , Sam' s Club , Walmart and Ralphs Recalled for Listeria, article published Jul. 23, 2014, 3 total pages.

*Primary Examiner* — Ernesto A Grano
(74) *Attorney, Agent, or Firm* — SoCal IP Law Group LLP; Guy Cumberbatch; Steven C. Sereboff

(57) ABSTRACT

A system and method for storing, shipping, and displaying produce in a box which has a tamper-evident closure. The box may be formed of folded cardboard and a transparent plastic lid which engages top edges of the box. The lid has a plurality of tabs around its periphery that may be bent and inserted into slots or notches formed in the box edges, and then expand to a larger relaxed size. The slots or notches have perforated lines enabling the lid to be ripped upward to open the box, thus indicating that the container has been tampered with.

24 Claims, 9 Drawing Sheets

(56) References Cited

U.S. PATENT DOCUMENTS

| | | | | |
|---|---|---|---|---|
| 5,348,549 | A * | 9/1994 | Brown | A61B 50/36 206/366 |
| 5,979,691 | A * | 11/1999 | Von Holdt | B65D 43/0256 220/266 |
| 6,367,690 | B1 | 4/2002 | McClure | |
| 6,931,821 | B2 * | 8/2005 | Wong | B65D 55/16 53/420 |
| 7,628,312 | B2 | 12/2009 | Mittelstaedt et al. | |
| 8,573,399 | B2 * | 11/2013 | Ulmer | B65D 21/062 206/503 |
| 9,238,523 | B1 * | 1/2016 | Frost | B65D 5/324 |
| 10,470,835 | B2 * | 11/2019 | Healey | A61B 17/865 |
| 2004/0035867 | A1 * | 2/2004 | Schultz | B65D 51/249 220/212 |
| 2004/0050849 | A1 * | 3/2004 | Pickles | B65D 43/0218 220/324 |
| 2005/0017061 | A1 * | 1/2005 | Quaintance | B65D 5/0035 229/125.28 |
| 2019/0039789 | A1 * | 2/2019 | Stein | B65D 43/0235 |
| 2019/0161232 | A1 * | 5/2019 | Katsuma | B65D 5/6608 |
| 2019/0300245 | A1 * | 10/2019 | Wright | B65D 11/10 |
| 2019/0337683 | A1 * | 11/2019 | Nie | B65D 43/021 |
| 2020/0055641 | A1 * | 2/2020 | Chang | B65D 43/0266 |
| 2020/0115117 | A1 * | 4/2020 | Tsertsvadze | B65D 43/0254 |
| 2020/0148428 | A1 * | 5/2020 | Georgiadis | B65D 43/26 |

* cited by examiner (c) 2020 Mission Produce, Inc.

(c) 2020 Mission Produce, Inc.

(c) 2020 Mission Produce, Inc.

(c) 2020 Mission Produce, Inc.

(c) 2020 Mission Produce, Inc.

(c) 2020 Mission Produce, Inc.

(c) 2020 Mission Produce, Inc.

(c) 2020 Mission Produce, Inc.

(c) 2020 Mission Produce, Inc.

TAMPER-EVIDENT PRODUCE CONTAINER

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

Field

This disclosure relates to a system and method for storing, shipping, and displaying produce in a box which has a tamper-evident closure.

Description of the Related Art

Storage containers are of growing importance in commerce as more products are being shipped to retailers in individual containers rather than in bulk. Depending on the product being shipped, the storage container may need to be specially designed to both fit and protect the product. To ship fruits and vegetables, boxes are used to protect the produce from being damaged during shipping and handling. Also, the box needs to have sufficient strength to withstand stacking several containers upon each other without crushing from the overall weight. Desirably, the same box used for shipping is also sold in the retail environment, and thus the produce should be visible within the box.

In the food packaging industry in general, products are often packaged in a container that is sealed against tampering and made to maintain integrity during shipping, storage, and handling. For produce storage containers, this is typically done by forming a corrugated tray, loading the product into the tray, and then sealing the tray closed with side flaps or a lid and tape, glue or the like.

DETAILED DESCRIPTION

There is disclosed a tamper-evident container for storing, shipping, and displaying produce which is easier to assemble and more visually appealing to the customer. The container comprises a box and a closure system.

The box may be formed of folded cardboard. The box is rigid and capable of protecting produce from bruising, unlike a bag. The box also can easily be stacked for shipping, and may be sufficiently strong to permit stacking of up to ten boxes on top of one another.

The closure system features a lid that fits onto the box and has tabs that engage the box edges. With the tabs in place, the lid cannot be easily or accidentally removed by an ordinary person, nor accidentally removed during ordinary shipping and transport. The closure system is economical and simple to use and requires no tape, no film seal, no straps, and no sleeves. The lid may be transparent plastic which engages top edges of the box. The lid may be a separate element from the box as opposed to folded flaps extending up from the box sides. The lid has a plurality of tabs around its periphery that may be bent and inserted into slots or notches formed in the box edges. The slots or notches have perforated lines enabling the lid to be ripped upward to allow opening of the box by an ordinary person, thus also indicating that the contents have been tampered with. The tabs may be semi-locked into place and the box has perforations that are ripped to allow removal of the lid, thus providing tamper evidence. The tabs may have fingers that are inserted into and concealed by slots or notches formed in the box to prevent easy removal. The tabs may be resilient and relatively simply inserted into the slots or notches during assembly.

Figure 1:
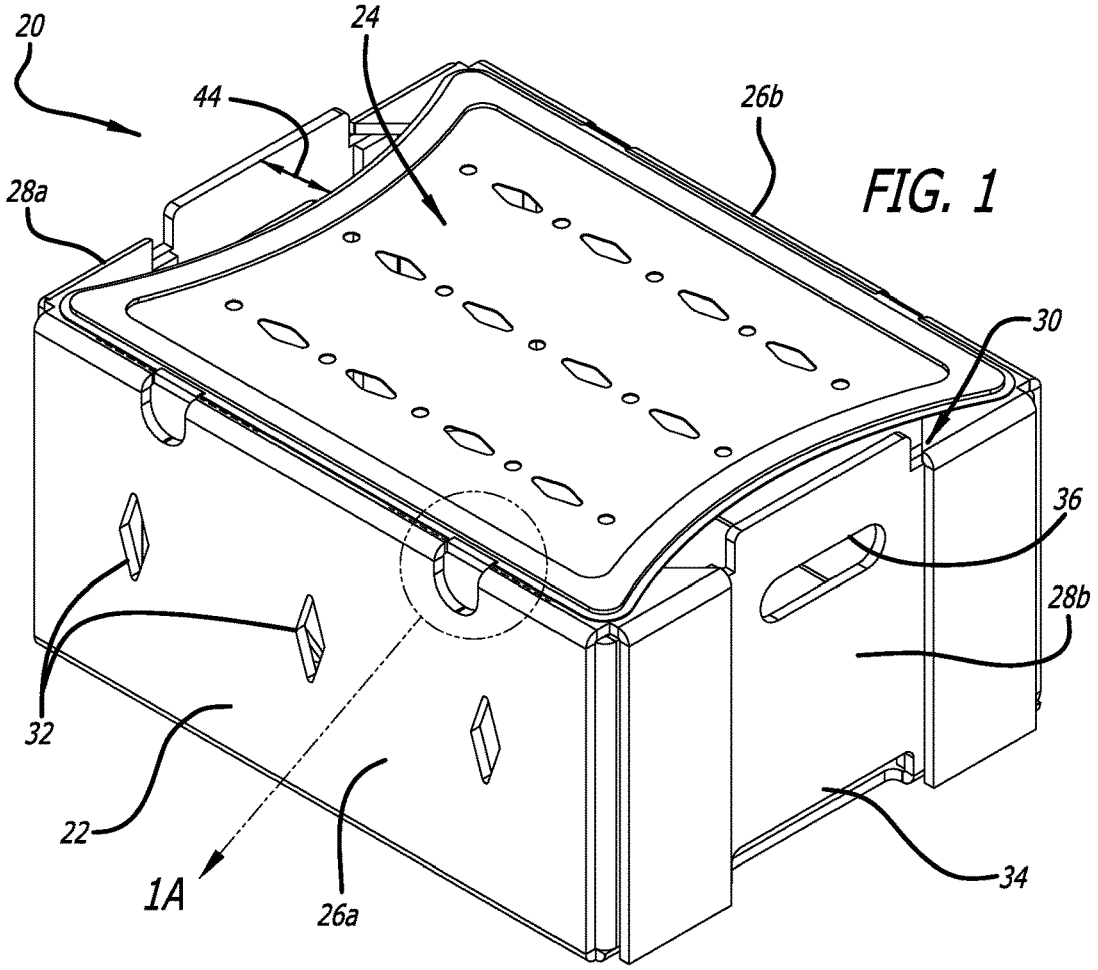
FIG. 1 is a perspective view of an assembled tamper-evident produce container in accordance with the present disclosure.

FIG. 1 is a perspective view of an assembled tamper-evident produce container 20. The produce container 20 comprises a lower rectilinear box 22 having a lid 24 secured thereon. The box 22 may include a floor (not shown), opposite upstanding front 26*a* and rear 26*b* side walls, and opposite left 28*a* and right 28*b* end walls. The walls 26, 28 are shown as planar and vertically-oriented, but could be angled or shaped. The box 22 defines an upper mouth which the lid engages and an inner cavity 30 that is desirably large enough to contain a number of items of produce. For example, the inner cavity 30 may be sufficiently large to hold up to 14 avocados. Of course, the storage capacity of the inner cavity 30 may vary greatly, with a happy medium being around 6-8 avocados or other items of similarly-sized produce which is an optimum range for consumers in a retail environment, and also does not overload the container 20 so that it remains easy to carry.

The box 22 may be formed of a single blank of folded cardboard. The lid 24 may be made of transparent plastic to enable visualization of the contents within the box 22.

Figure 2A:
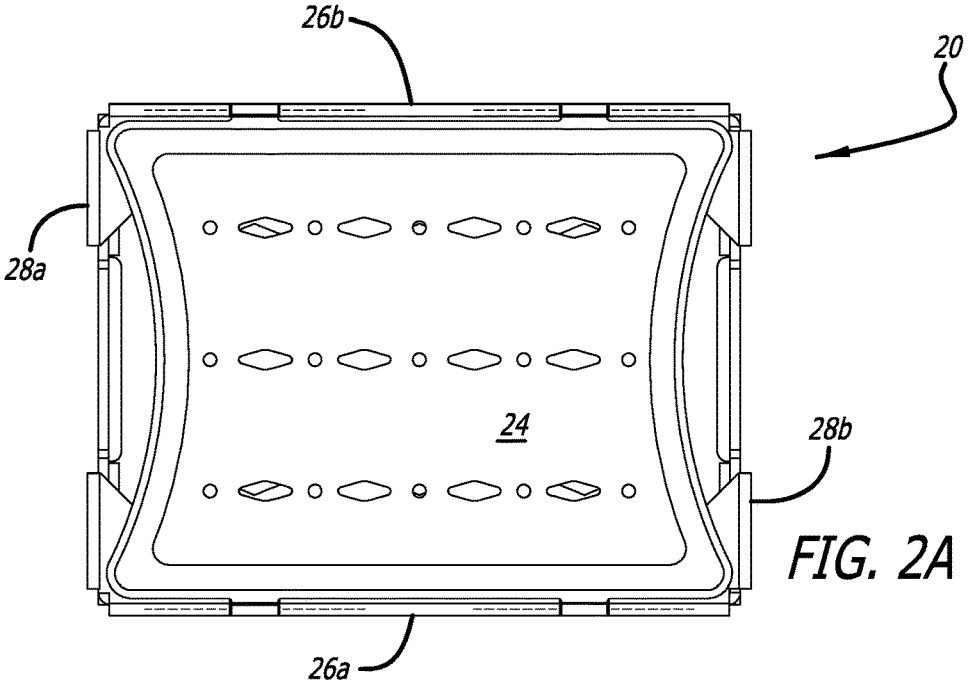
FIGS. 2A-2C are top plan, side and end elevational views of the tamper-evident produce container of FIG. 1.
Figure 2B:
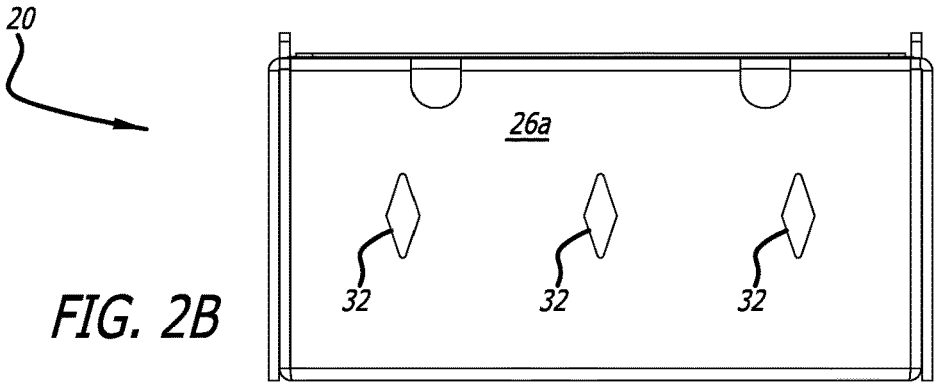
Figure 2C:
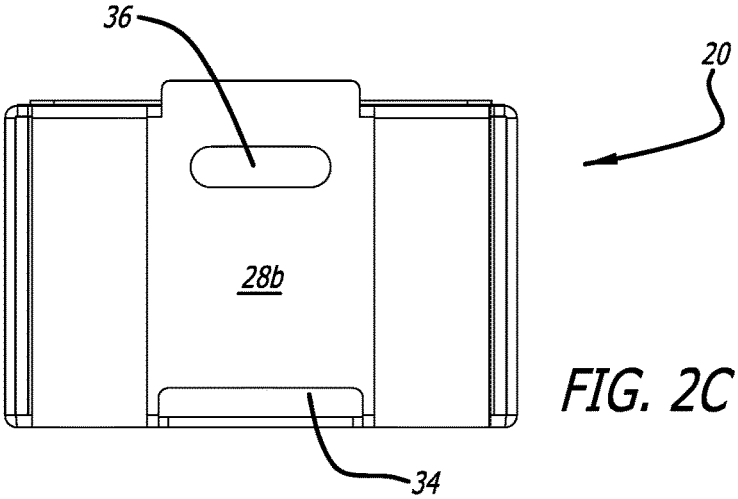

As seen also in FIGS. 2A-2C, both the walls of the box 22 and the lid 24 have a plurality of vents. The vents permit good airflow to the inner cavity 30 and avoid excess buildup of moisture therein, thus reducing humidity and slowing down any fungal growth. Namely, the side walls 26*a*, 26*b* may have a series of evenly-spaced diamond-shaped openings 32 arrayed along their midsections. The end walls 28*a*, 28*b* each may have a linear slot 34 formed at a lower corner, and a pair of oval-shaped handle openings 36 toward an upper middle portion.

Figure 3:
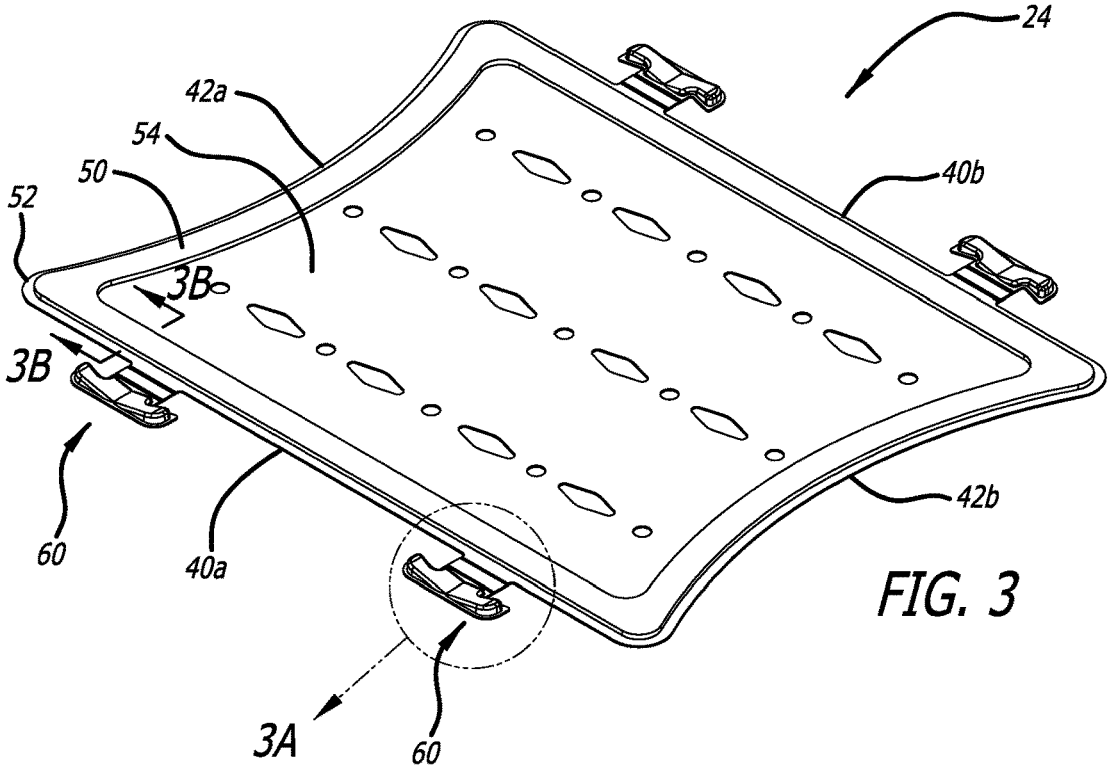
FIG. 3 is a perspective view of the lid of the tamper-evident produce container.

The lid 24, as also seen isolated in FIG. 3, is generally flat with a somewhat rectangular shape. The lid 24 defines linear front 40*a* and rear 40*b* side edges joined by arcuate left 42*a* and right 42*b* end edges. The end edges 42*a*, 42*b* are concave and bowed inward toward each other to create gaps 44 between the edges and the end walls 28*a*, 28*b*, as seen in FIG. 1. The gaps 44 further facilitate airflow around the produce within the inner cavity 30.

The lid 24 may be reinforced to provide stiffness in contrast to a totally flat panel of transparent plastic material. As seen in FIG. 3 and FIG. 3B, a generally rectangular raised band 50 separates a horizontal outer peripheral edge 52 from a horizontal central main panel 54. The entire midsection of the lid 24 within the outer peripheral edge 52 is formed of a single panel of constant thickness polymer material, with the raised band 50 formed by a stamping process that creates inner 56 and outer 58 vertical steps. The steps 56, 58 may greatly increase the stiffness in bending around the periphery of the lid 24. The raised band 50 may have a substantially constant horizontal dimension and tracks the shape of the outer peripheral edge 52 such that it extends linearly parallel to the side edges 40*a*, 40*b* and has an arcuate, concave shape parallel to the end edges 42*a*, 42*b*.

Figure 1A:
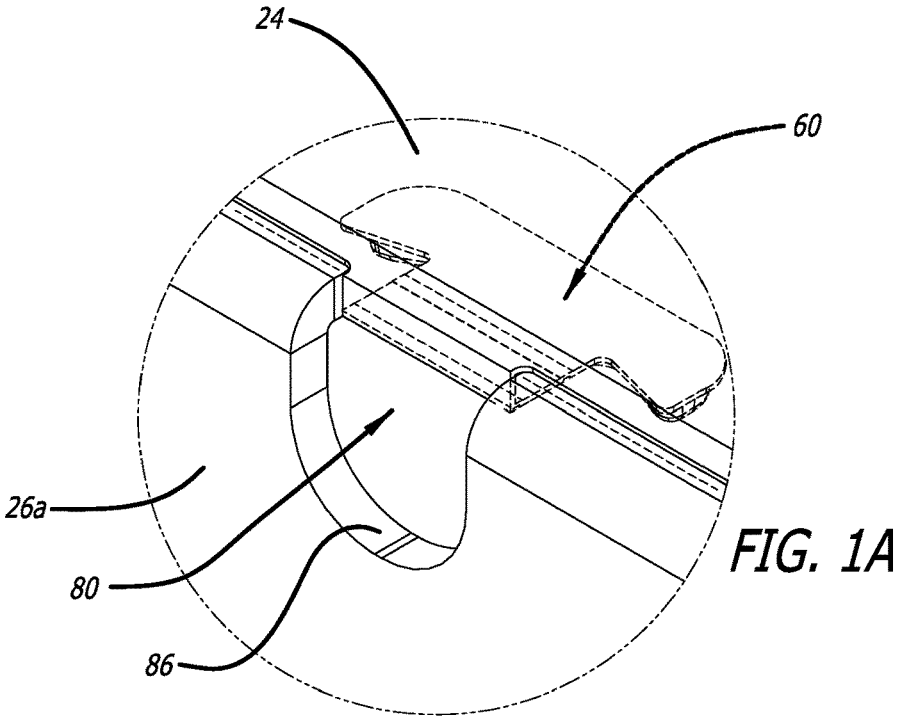
FIG. 1A is an enlargement of an engagement between a tab of the lid and a lower box.

With reference to FIG. 3 and the enlargement of FIG. 1A, a plurality of tabs 60 extend horizontally outward from the linear side edges 40*a*, 40*b* of the lid 24 so as to engage the box 22. The lid 24 may be fastened to the upper mouth of the box 22 so as to enclose the inner cavity. In this respect, the lid 24 is a separate element from the box 22 and thus can be completely removed to expose the inner cavity 30 and produce therein. There may be a plurality of tabs 60 spaced along each linear side edge 40*a*, 40*b* of the lid 24 such that the lid is securely fastened over the upper mouth on two opposed sides when the tabs are engaged. As an alternative, only the tabs 60 along one of the linear side edges 40*a* or 40*b* are disengaged to enable pivoting of the lid open about the other side edge 40*a* or 40*b*.

Figure 3A:
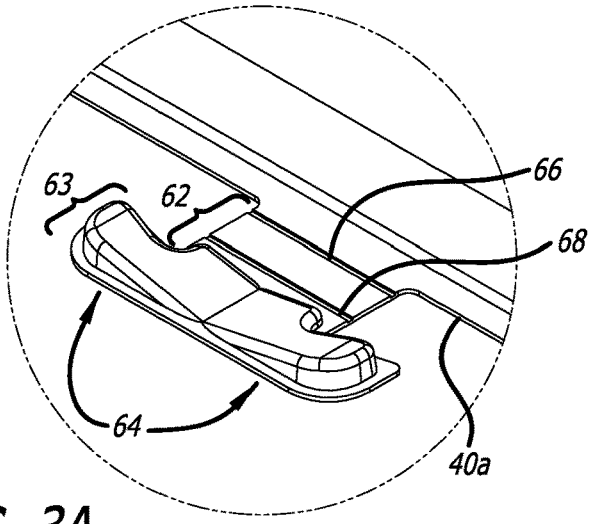
FIG. 3A is an enlargement of one of the tabs thereof.
Figure 3B:
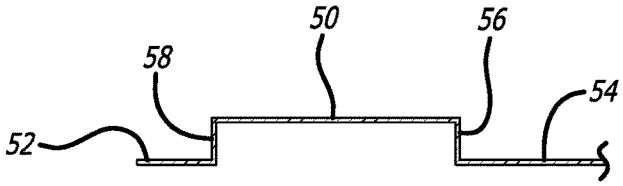
FIG. 3B is a section through one edge of the lid.

FIG. 3A is an enlargement of one of the tabs 60, which includes a flat, two-dimensional neck portion 62 leading to a three-dimensional outer portion 63 having bifurcated wings 64. The neck portion 62 extends perpendicularly outward from the outer peripheral edge 52 and includes first and second hinges 66, 68, respectively. The hinges 66, 68 extend parallel to the linear side edges 40*a*, 40*b* and may be formed by channels or linear notches (i.e., living hinges) stamped into the plastic material of the neck portion 62. The hinges 66, 68 permit the outer portion 63 to bend 180° underneath the midsection of the lid 24.

Figure 4:
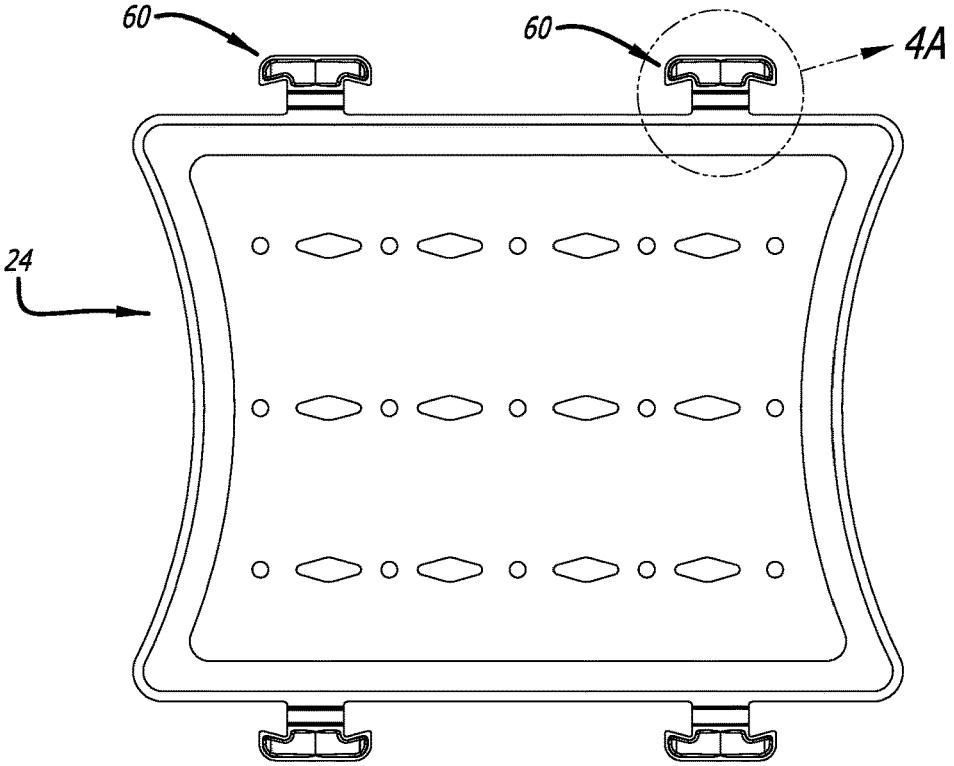
FIG. 4 is a top plan view of the lid of the tamper-evident produce container.
Figure 4A:
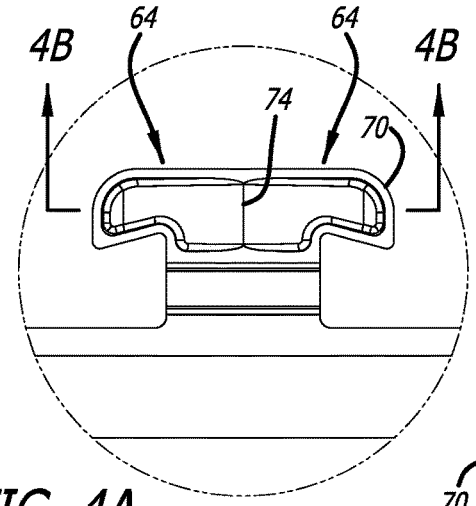
FIG. 4A is an enlargement of one of the tabs of the lid.
Figure 4B:
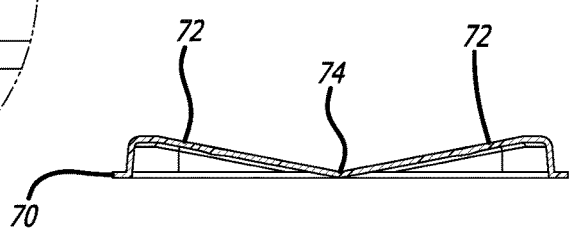
FIG. 4B is a sectional view through the tab taken along line 4B-4B of FIG. 4A.

With reference also to FIGS. 4 and 4A-4B, the outer portion 63 of each tab 60 defines an outer rim 70 surrounding two wedge-shaped raised portions 72. The raised portions 72 are symmetric about a linear hinge 74. Due to the raised nature of the raised portion 72, each may be relatively stiff in bending but may more easily be bent with respect to each other about the hinge 74. Each of the bifurcated wings 64 comprises one of the raised portions 72 and the portion of the outer rim 70 that surrounds it.

The lid tabs 60 extend outward and each engages a receiving notch 80 in the box 22. In terms of the number of tabs 60 and notches 80, there should be at least one pair preventing easy opening of the lid 24. That is, the lid 24 may be securely fastened to the upper mouth of the box 22 along one side edge, with the lid extending across to one or more tabs 60 held within a receiving notch 80. To best prevent tampering, there are at least two pairs of tabs 60 and notches 80 along at least one top edge of the box. In the illustrated embodiment there are four pairs of tabs 60 and notches 80, two on each opposed linear side, to hold the lid in place during shipping and prevent tampering. The tab/notch pairs are desirably spaced close enough to an adjacent corner to deter simply flexing the corner and middle portion of the lid 24 upward to gain access to the box contents.

Figure 5A:
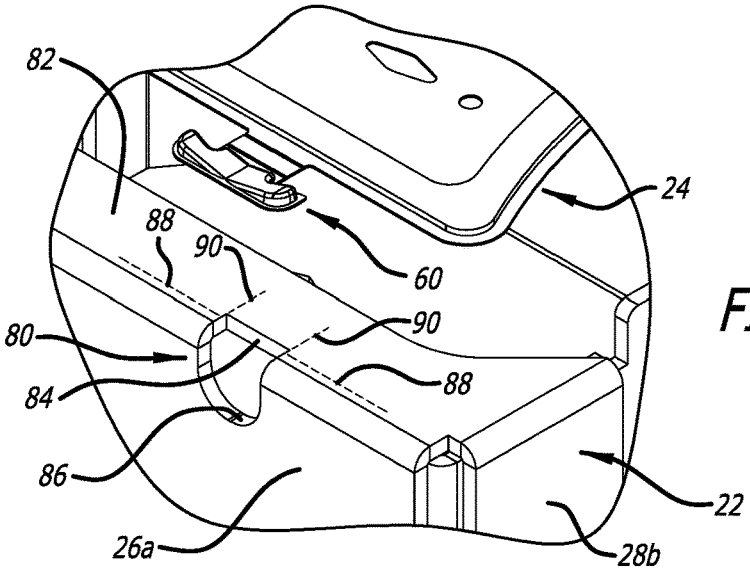
FIGS. 5A-5E are perspective enlarged views of a sequence of inserting one of the tabs of the lid into a receiving notch in the box of the tamper-evident container.

FIGS. 5A-5F are perspective enlarged views of a sequence of inserting one of the tabs 60 of the lid into a receiving notch 80 in the box 22 of the tamper-evident container. FIG. 5A shows a corner of the lid 24 exploded over a corner of the box 22. The box 22 is configured and folded so as to form a horizontal shelf 82 extending inward at the upper edges of the front and rear side walls 26*a*, 26*b*. The shelf 82 also connects along a short distance of the end walls 28*a*, 28*b*. The shelf 82 provides reinforcement to the upper mouth of the box 22, and also enables the lid 24 to be locked in place using the tabs 60, as will be shown and described.

Each receiving notch 80 has a lateral notch dimension which is smaller than a lateral tab dimension of the associated tab 60. For instance, the horizontal lateral dimension of each notch 80 parallel to its respective side wall 26*a*, 26*b* may be less than 1 inch, such as 0.700-0.850 inches, and preferably 0.75 inches, while the total lateral dimension of each tab 60 across the bifurcated wings 64 is greater and may be as much as twice as wide. Preferably, the lateral dimension across the bifurcated wings 64 is at least 1.830 times the lateral dimension of each notch 80. In the example where the lateral notch dimension is 0.75 inches, each tab 60 may be between 1.3-1.5 inches wide, such as 1.373 inches wide.

The neck portion 62 has a lateral dimension slightly less than the lateral dimension of each notch 80, and specifically the neck portion 62 may be between 0.650-0.825 inches wide. The neck portion 62 may be 0.050-0.075 inches less than the lateral notch dimension to provide good retention capacity. For example if the lateral notch dimension is 0.75 inches the neck portion 62 is at least 0.70 inches wide. All tolerances for the purpose of manufacturing should be ±0.010 inches.

Figure 5B:
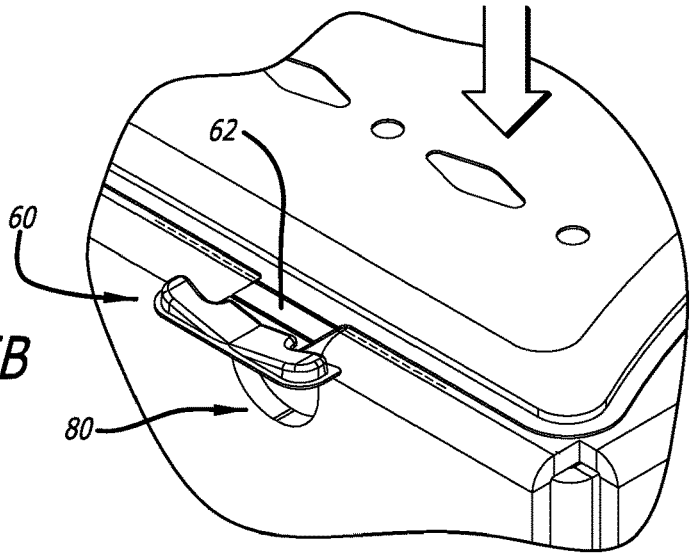

Initially, the lid 24 is lowered as seen in FIG. 5B such that the neck portion 62 of each tab 60 is positioned directly over one of the receiving notches 80. With reference again to FIG. 5A, each notch 80 commences with a rectangular cutout 84 in the horizontal shelf 82, and continues downward in a generally semi-circular cutout 86 in the adjacent side wall 26*a*, 26*b*. Still with regard to FIG. 5B, a pair of lines of weakness 88, such as scored or perforated lines, extend laterally (parallel to the nearest side wall 26*a*, 26*b*) through the shelf 82, one on each side of the notches 80. A second parallel pair of lines of weakness 90, such as scored or perforated lines, extend inward from the respective notch 80 (perpendicular to the lines of weakness 88) and through the shelf 82. These lines of weakness 88, 90 enable the tabs 60 to be pulled free by an ordinary person from their engagement with the notches to allow removal of the lid 24.

Each tab 60 may be inserted into one of the notches 80 of the box 22 such that the lid 24 is secured to the box and encloses the inner cavity. To do so, each tab 60 may have a relaxed configuration with a lateral tab dimension across the wings 64 larger than the lateral notch dimension, and each tab is configured to be bent into an insertion configuration having a reduced lateral dimension smaller than the notch dimension so as to fit through one of the notches. Once inserted into the notch 80, the tab 60 flexes back to the relaxed configuration and resists removal from the notch, and thus that portion of the lid 24 from the box 22.

Figure 5C:
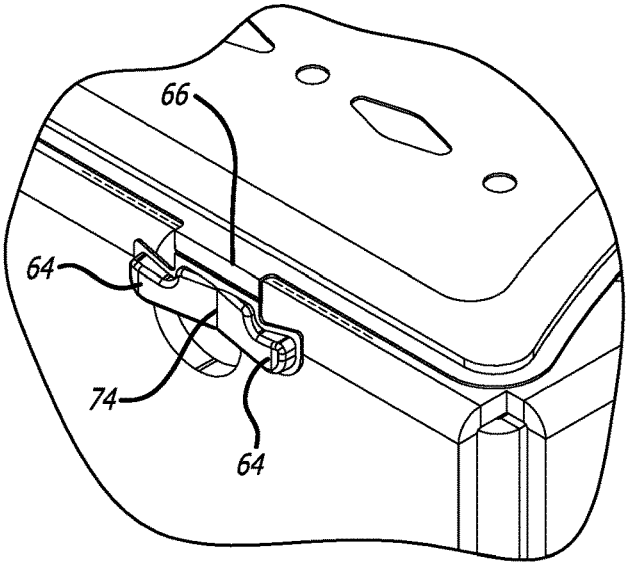
Figure 5D:
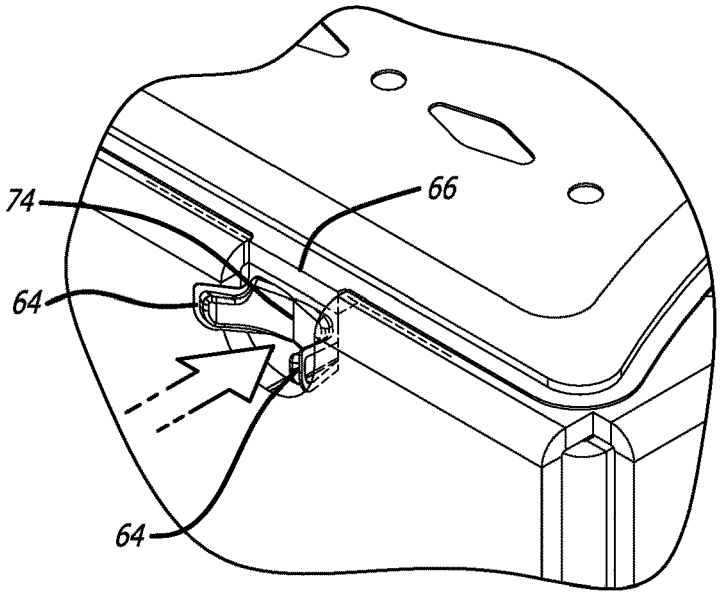
Figure 5E:
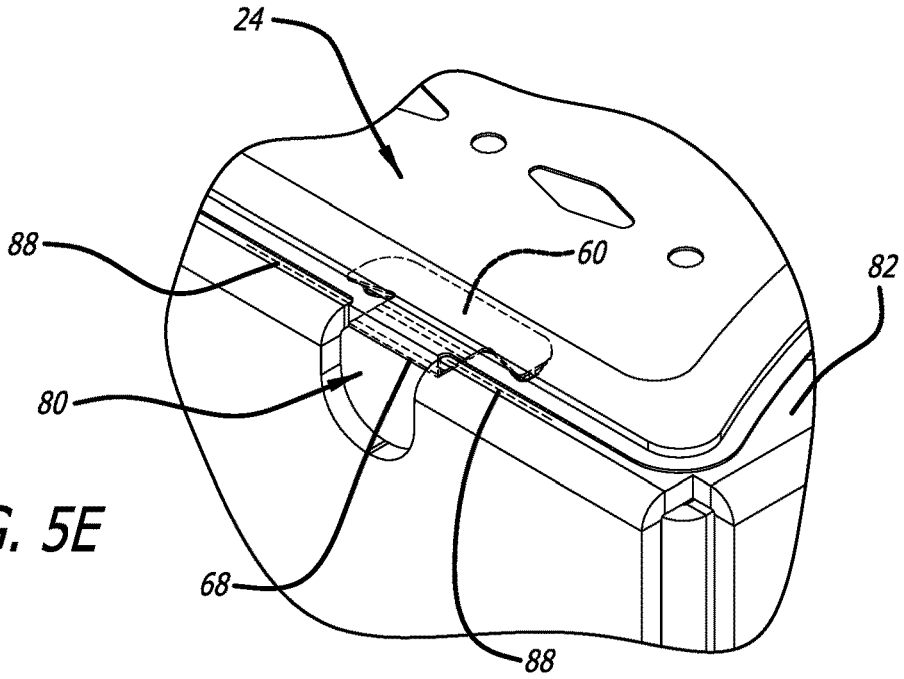

With reference now to FIG. 5C, the tab 60 is shown bent 90° downward about the first hinge 66. The rectangular cut out 84 provides a sharp corner about which to bend the tab 60. At this stage, the oppositely-directed wings 64 extend on both side of the notch 80. As shown in FIG. 5D, application of an inward force to the middle of the tab 60 causes the tab 60 to flex inward about the hinge 74 into the notch 80. Both of the wings 64 deform so as to pass from the outside to the inside of the front wall 26*a* through the notch 80, and then expand. Continued application of inward force on the tab 60 eventually causes it to wrap underneath the horizontal shelf 82, as shown in FIG. 5E. The thickness of the shelf 82 is approximately the same as the distance between the first and second hinges 66, 68 (see FIG. 3A), such that the second hinge 68 creates a 90° bend below the shelf 82.

When in the locked position seen in FIG. 5E, both of the wings 64 relax to their original shape underneath the horizontal shelf 82. This locks that portion of the lid 24 to the box 22. Because the wings 64 have expanded outward and lie underneath the shelf 82, they are not visible from above. Furthermore, the wings 64 and the notches 80 may be configured such that it is extremely difficult to reverse this operation and pull the wings 64 back out of the notches 80 due to their relative stiffness. Consequently, when all of the tabs 60 have been locked into the notches 80, as seen in FIG. 1, the lid 24 securely fastened to the box 22.

Once the tamper-evident produce container 20 is assembled as in FIG. 1, the produce therein may be visible through the transparent plastic material of the lid 24, but the gaps between the lid and the box 22 may be small enough to prevent removal of any single items of produce. The lid 24 can practically only be removed by pulling upward at one of the corners, which tears the tabs 60 near that corner upward through the lines of weakness 88, 90 at the corresponding notch 80. This tears the box between the vertical wall 26*a*, 26*b* and the adjacent horizontal shelf 82, and inward along the shelf at the lines of weakness 90, which is readily apparent and provides the tamper-evident indicator.

Figure 6A:
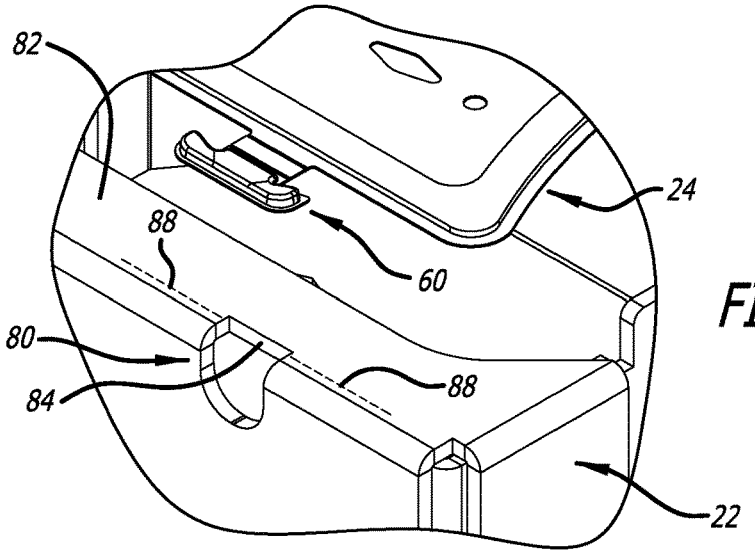
FIGS. 6A-6E are perspective enlarged views of an alternative sequence of inserting one of the tabs of the lid into a receiving notch in the box of the tamper-evident container.
Figure 6B:
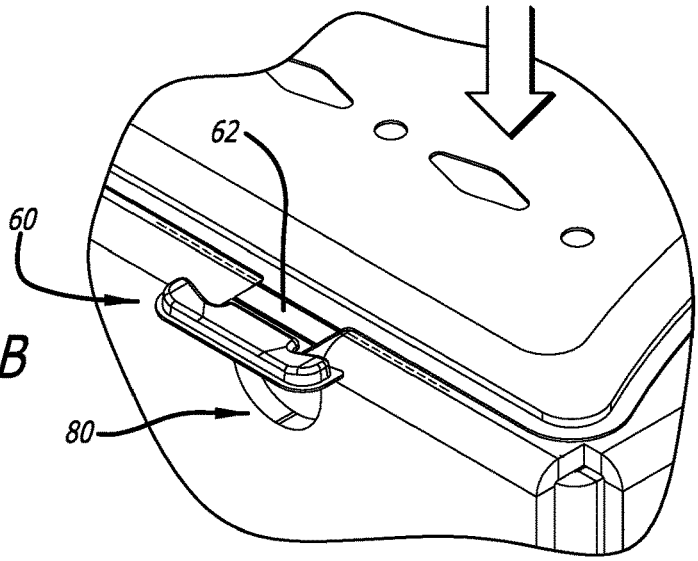
Figure 6C:
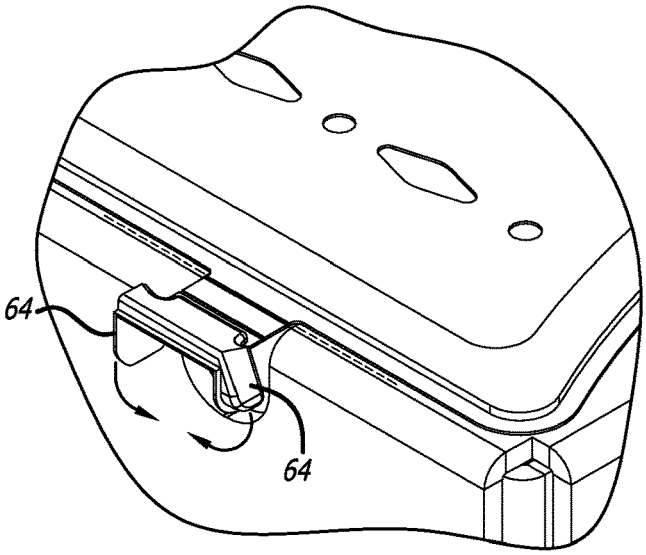

FIGS. 6A-6E are perspective enlarged views of an alternative sequence of inserting one of the tabs 60 of the lid into a receiving notch 80. The lid 24 is lowered down so that the neck portion 62 of each of the tabs 60 lies above one of the notches 80. FIG. 6C indicates an alternative way to deform the tabs 60 wherein the bifurcated wings 64 are bent in a direction opposite that shown in FIG. 5D. This is somewhat harder than the first technique because of the bending stiffness of the three-dimensional tasks 60, but nevertheless can be done.

Figure 6D:
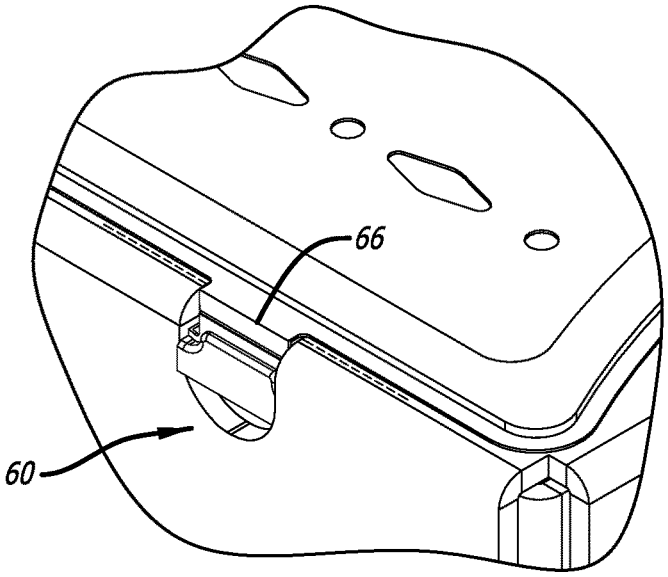
Figure 6E:
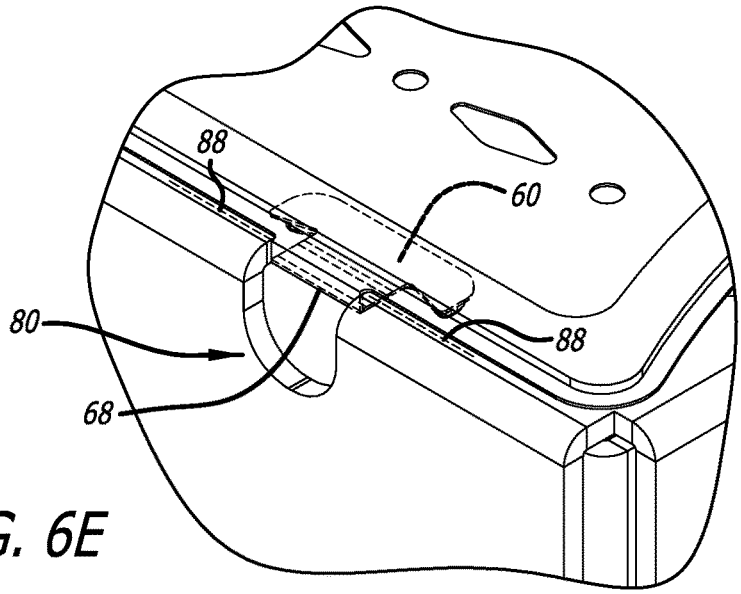

FIG. 6D shows the tab 60 having been bent 90° about the first hinge 66 and the wings 64 being inserted through the notch 80. Finally, the tabs 60 are bent an additional 90° about the second hinge 68 so as to lie flat underneath the horizontal shelf 82. The resiliency of the plastic tabs 60 enable the wings 64 to relax to their original oppositely-directed orientations which tends to lock the tabs 60 into the notches 80.

Figure 7:
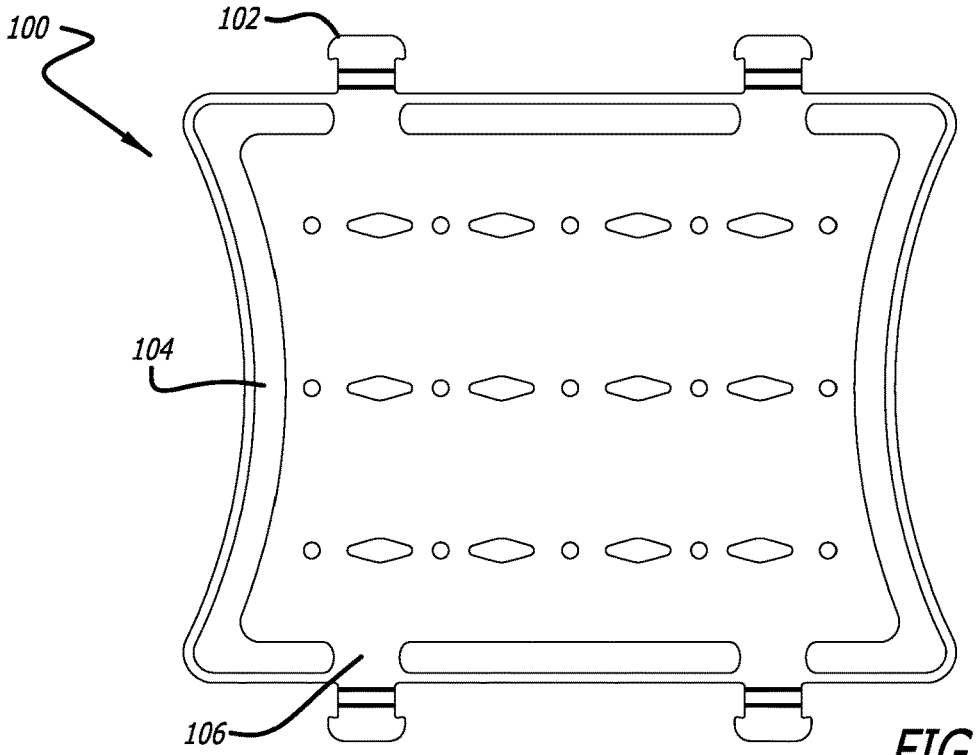
FIG. 7 is a top plan view of an alternative lid for use with the tamper-evident container.

FIG. 7 is a top plan view of an alternative lid 100 for use with the tamper-evident container 20. The lid 100 as shown has four tabs 102, two on each of the linear sides of the lid 100. The tabs 102 may be configured the same as the tabs 60, described above, though in the illustrated embodiment wings are somewhat shorter in length. Furthermore, the tabs 102 may be simple flat strips as opposed to being three-dimensional. Another difference is that a raised reinforcing band 104 extending generally around the periphery of the lid 100 is interrupted at gaps 106 adjacent each of the tabs 102.

Figure 8:
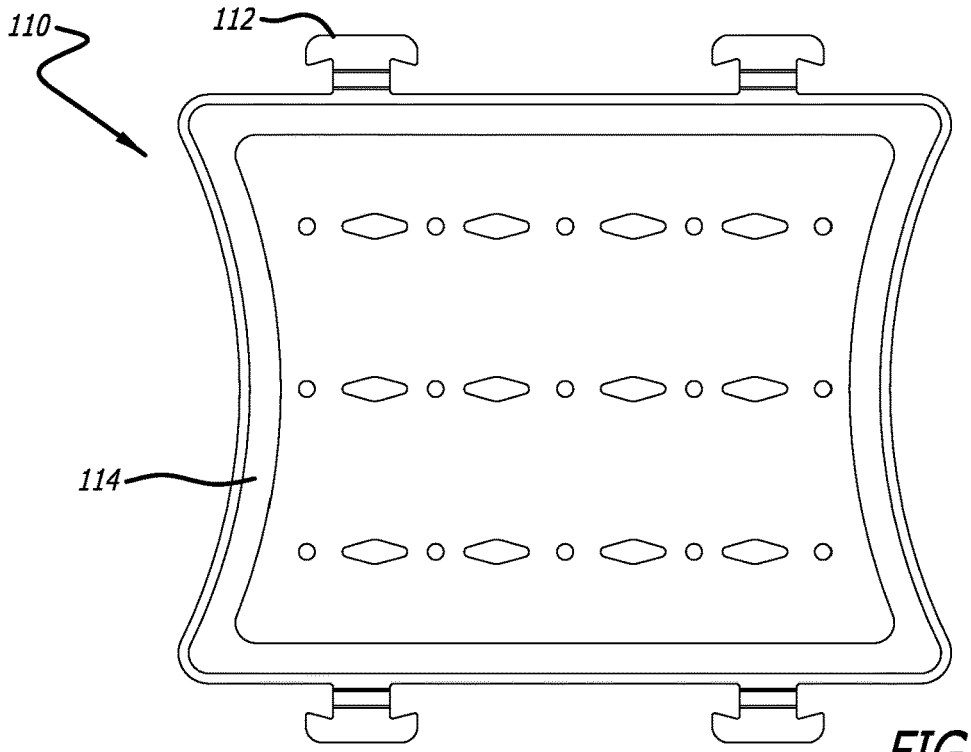
FIG. 8 is a top plan view of a further alternative lid for use with the tamper-evident container.

FIG. 8 is a top plan view of a still further alternative lid 110 for use with the tamper-evident container. The lid 110 is similar in respect to the first-described lid 24, except for the tabs 112 which are flat as opposed to being three-dimensional. The wings of the tabs 112 are also wider laterally than the wings of the tabs 102 in FIG. 7. A continuous raised reinforcing band 114 extends round the entire periphery of the lid 110 closely spaced inward from the outer edge.

The various produce containers described herein provide a sturdy, tamper-evident box which requires no tape, no film seal, no straps, and no sleeves to hold the lid on the box. Additionally, the container is not a bag which cannot be stacked, it is instead a sturdy box with lid that can be stacked several high. Further, the lid has tabs that cannot easily be removed from the box.

In terms of "easily," this means that a lid that cannot be removed by an ordinary person without significant difficulty, requiring both force and time and perhaps tools, short of tearing either the box or the lid which evidences tampering. The opening formed by each notch 80 is sufficiently small as to prevent an ordinary person from inserting his or her finger and thumb through the notch to manipulate the tabs 60. The lateral dimension of each notch 80 may be less than 1 inch, desirably 0.75 inches. This dimension is roughly the height of the notch 80 due to its semi-circular shape. An ordinary person would thus have a hard time wedging their finger and thumb through the notch 80 to squeeze the wings 64 and to enable retraction of the tab 60. Even a person with small hands would find the task difficult, as the combined thickness of the finger and thumb might barely fit through the notch 80, but the two digits would not then be able to open sufficiently to manipulate the tab wings 64.

On the other hand, the lid can easily be removed, by pulling upward on the lid which tears the sides of the notches in which the tabs are retained. Further, the lid is clear and the produce visible through the lid, and numerous vent holes are provided in both the box and lid. The lid and box are two pieces, instead of a folded box with an integrated lid.

Engagement of the lid tabs 60 with the receiving notches 80 provides a relatively robust enclosure which can withstand casual prying from, for instance, retail customers wishing to check ripeness. The preferred pull tear strength of the score lines above the notch is 12-15 lbs. in opening (tearing) force. This means that if a person pulls on one corner of the plastic lid, the scored lines are designed to withstand at least 12 lbs. of force before separating open. The notch openings 80 are also placed at the four corners of the plastic lid 24 to prevent someone from bending back the corner of the lid to access the product inside the box without tearing the tamper evident score lines above the notch opening.

Another variation on the tamper-evident produce container disclosed herein is to reverse the placement of the tabs and notches. That is, the tabs could extend upward from the box edges, and be wrapped over the lid edge and be inserted into notches in the lid. Due to the small size of the notch openings, it is near impossible for someone to reach in and squeeze the tab wings to retract the tabs without force and time and perhaps tools. Perforations in the lid that commence at the notches could be easily ripped when opening the container, thus evidencing tampering.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

Unless otherwise indicated or the context suggests otherwise, as used herein, "a" or "an" means "at least one" or "one or more." Furthermore, unless otherwise stated, any specific dimensions mentioned in this description are merely representative of an exemplary implementation of a device embodying aspects of the device and are not intended to be limiting.

It is claimed:

1. A tamper-evident produce container comprising:

a box having a floor and upstanding walls defining an upper mouth and an inner cavity therebetween sized to receive produce, wherein the upstanding walls have at least two notches at upper edges located on opposite sides of the box, each of the notches having a lateral notch dimension, and wherein the box further forms a horizontal shelf extending along at least two sides inward from respective upper edges at the notches; and a transparent lid defining outer sides with a plurality of tabs projecting outward therefrom, wherein each tab may be inserted into one of the notches of the box such that the lid is secured to the box and encloses the inner cavity, and wherein each tab has a relaxed configuration which has a lateral tab dimension larger than the notch dimension and is configured to be bent into an insertion configuration having a reduced lateral dimension smaller than the notch dimension so as to fit through one of the notches, and wherein once inserted into the notch the tab flexes back to the relaxed configuration and resists removal from the notch, and wherein the box has a pair of lines of weakness in the shelf extending away from each notch which is adapted to tear when the lid is forcefully pulled upward from the box.

2. The container of claim 1, wherein each tab has a neck portion leading to two outer laterally-extending wings configured to be bent along a flex line between the two wings into the insertion configuration.

3. The container of claim 2, wherein each wing of each tab has a three-dimensional wedge shape that is thinnest at the flex line and thicker farther away from the flex line.

4. The container of claim 3, wherein the lid is molded of transparent plastic.

5. The container of claim 3, wherein the neck portion of each tab defines two laterally-extending hinges spaced apart a distance at least as great as a thickness of the horizontal shelf such that each tab can be bent 180° from its relaxed configuration into the notch and underneath the horizontal shelf.

6. The container of claim 1, wherein the lid is molded plastic and defines a raised reinforcing band extending around at least a substantial extent of a periphery of the lid just inside the outer sides.

7. The container of claim 1, wherein the pair of lines of weakness in the shelf is a first pair of lines of weakness that extends laterally away from each notch between the respective upper edges and the horizontal shelf, and further including a second pair of parallel lines of weakness in the shelf extending inward from the notch and perpendicular to the first pair of lines of weakness.

8. The container of claim 1, wherein the lid includes a plurality of vent holes formed in a midportion to permit airflow through the box.

9. The container of claim 8, wherein the box includes a plurality of vent holes formed therein to permit airflow through the box.

10. The container of claim 9, wherein the box has a rectangular plan view shape, and the lid has a generally rectangular peripheral shape with opposed straight sides in which there are two of the tabs each, and opposed concave ends which form gaps with ends of the box when engaged thereto.

11. A tamper-evident produce container, including:

a box having a floor and upstanding walls defining an upper mouth and an inner cavity therebetween sized to receive produce, the box having a rectangular plan view shape, wherein the upstanding walls have at least two notches at upper edges located on opposite sides of the box main body, each of the notches having a lateral notch dimension, and wherein the box further forms a horizontal shelf extending along at least two sides inward from respective upper edges at the notches; and a lid defining a generally rectangular peripheral shape with outer sides including opposed straight sides from each of which at least two tabs project outward therefrom, wherein each tab has a neck portion leading to two outer laterally-extending wings configured to be bent along a flex line between the two wings into the insertion configuration, wherein each wing of each tab has a three-dimensional wedge shape that is thinnest at the flex line and thicker farther away from the flex line, and wherein each tab may be inserted into one of the notches of the box such that the lid is secured to the box and encloses the inner cavity, and wherein each tab has a relaxed configuration which has a lateral tab dimension across the wings larger than the notch dimension and is configured to be bent into an insertion configuration having a reduced lateral dimension smaller than the notch dimension so as to fit through one of the notches.

12. The container of claim 11, wherein the box has a first pair of lines of weakness that extends laterally away from each notch between the respective upper edges and the horizontal shelf which is adapted to tear when the lid is forcefully pulled upward from the box.

13. The container of claim 12, further including a second pair of parallel lines of weakness in the shelf extending inward from the notch and perpendicular to the first pair of lines of weakness.

14. The container of claim 11, wherein the lid is molded of transparent plastic.

15. The container of claim 11, wherein the neck portion of each tab defines two laterally-extending hinges spaced apart a distance at least as great as a thickness of the horizontal shelf such that each tab can be bent 180° from its relaxed configuration into the notch and underneath the horizontal shelf.

16. The container of claim 11, wherein the lid is molded plastic and defines a raised band extending around at least a substantial extent of a periphery of the lid just inside the outer sides.

17. The container of claim 11, wherein the lid includes a plurality of vent holes formed in a midportion to permit airflow through the box.

18. The container of claim 17, wherein the box includes a plurality of vent holes formed therein to permit airflow through the box.

19. The container of claim 18, wherein the lid has opposed concave ends which form gaps with ends of the box when engaged thereto.

20. A tamper-evident produce container, including:

a box having a floor and upstanding walls defining an upper mouth and an inner cavity therebetween sized to receive produce, the box having a rectangular plan view shape, wherein the upstanding walls have at least two notches at upper edges located on opposite sides of the box, each of the notches having a lateral notch dimension, and wherein the box further forms a horizontal shelf extending along at least two sides inward from respective upper edges at the notches; and a lid defining a generally rectangular peripheral shape with outer sides including opposed straight sides from each of which at least two tabs project outward therefrom, wherein each tab has a neck portion leading to two outer laterally-extending wings configured to be bent along a flex line between the two wings into the insertion configuration, and wherein each tab may be inserted into one of the notches of the box such that the lid is secured to the box and encloses the inner cavity, and wherein each tab has a relaxed configuration which has a lateral tab dimension across the wings larger than the notch dimension and is configured to be bent into an insertion configuration having a reduced lateral dimension smaller than the notch dimension so as to fit through one of the notches, wherein the lid is molded plastic and defines a raised band extending around at least a substantial extent of a periphery of the lid just inside the outer sides.

21. The container of claim 20, wherein the box has a first pair of lines of weakness that extends laterally away from each notch between the respective upper edges and the horizontal shelf which is adapted to tear when the lid is forcefully pulled upward from the box.

22. The container of claim 20, further including a second pair of parallel lines of weakness in the shelf extending inward from the notch and perpendicular to the first pair of lines of weakness.

23. The container of claim 22, wherein the lid includes a plurality of vent holes formed in a midportion and the box includes a plurality of vent holes formed therein both to permit airflow through the box.

24. The container of claim 20, wherein the lid has opposed concave ends which form gaps with ends of the box when engaged thereto.

* * * * *